US006578987B1

(12) United States Patent
Hough et al.

(10) Patent No.: US 6,578,987 B1
(45) Date of Patent: Jun. 17, 2003

(54) INTRA-LENS COLOR AND DIMMING APPARATUS

(75) Inventors: Thomas A. Hough, Dallas; Richard K. Steele, Lewisville, both of TX (US)

(73) Assignee: Vari-Lite, Inc., Dallas, TX (US)

( * ) Notice: Subject to any disclaimer, the term of this patent is extended or adjusted under 35 U.S.C. 154(b) by 0 days.

(21) Appl. No.: 09/565,040

(22) Filed: May 3, 2000

(51) Int. Cl.[7] ..... F21V 13/14

(52) U.S. Cl. ..... 362/293; 362/281; 362/321; 362/268; 353/84; 353/97; 359/740; 359/889

(58) Field of Search ..... 362/268, 293, 362/281, 321, 331, 355; 353/84, 97; 359/227, 230, 599, 615, 738, 739, 740, 799, 800, 889, 892

(56) References Cited

U.S. PATENT DOCUMENTS

| | | | | |
|---|---|---|---|---|
| 3,069,536 A | | 12/1962 | Dion et al. | 362/280 |
| 3,933,408 A | * | 1/1976 | Reinert | 362/268 |
| 4,146,310 A | | 3/1979 | Kohayakawa et al. | 351/207 |
| 4,392,187 A | | 7/1983 | Bornhorst | 362/233 |
| 4,511,223 A | * | 4/1985 | Hirose | 362/268 |
| 4,602,321 A | | 7/1986 | Bornhorst | 362/268 |
| 4,745,531 A | | 5/1988 | Leclercq | 362/281 |
| 4,800,474 A | | 1/1989 | Bornhorst | 362/293 |
| 4,811,182 A | | 3/1989 | Solomon | 362/293 |
| 4,890,208 A | | 12/1989 | Izenour | 362/294 |
| 4,893,225 A | | 1/1990 | Solomon | 362/293 |
| 4,894,760 A | | 1/1990 | Callahan | 362/293 |
| 4,897,770 A | | 1/1990 | Solomon | 362/293 |
| 4,914,556 A | | 4/1990 | Richardson | 362/293 |
| 4,958,265 A | | 9/1990 | Solomon | 362/293 |
| 4,972,306 A | | 11/1990 | Bornhorst | 362/278 |
| 4,984,143 A | | 1/1991 | Richardson | 362/293 |
| 5,073,847 A | | 12/1991 | Bornhorst | 362/293 |
| 5,126,886 A | | 6/1992 | Richardson et al. | 359/888 |
| 5,186,536 A | | 2/1993 | Bornhorst et al. | 362/293 |
| 5,188,452 A | | 2/1993 | Ryan | 362/293 |
| 5,282,121 A | | 1/1994 | Bornhorst et al. | 362/294 |
| 5,416,681 A | | 5/1995 | Wu | 362/284 |
| 5,426,576 A | | 6/1995 | Hewlett | 362/293 |
| 5,497,234 A | | 3/1996 | Haga | 356/613 |
| 5,515,254 A | | 5/1996 | Smith et al. | 362/293 |
| 5,597,223 A | * | 1/1997 | Watanabe et al. | 353/97 |
| 5,622,426 A | | 4/1997 | Romano | 362/281 |
| 5,659,429 A | * | 8/1997 | Kudo | 359/740 |
| 5,790,329 A | | 8/1998 | Klaus et al. | 359/887 |
| 6,198,576 B1 | * | 3/2001 | Matsuyama | 359/740 |

FOREIGN PATENT DOCUMENTS

| | | |
|---|---|---|
| DE | 197 22 191 A1 | 12/1998 |
| FR | 2582779 | 12/1986 |
| FR | 2667954 | 4/1992 |
| GB | 2239938 A | 7/1991 |

* cited by examiner

*Primary Examiner*—Alan Cariaso
(74) *Attorney, Agent, or Firm*—Carr Law Firm, L.L.P.

(57) ABSTRACT

A stage lighting instrument having a high-intensity light source or lamp coupled with a concave reflector, and a projection optical system having a lens system that includes a well-defined aperture stop. The lens system forms a real image of the light source near the aperture stop. A color filter and dimming system may be located within the lens system so that the color filter and dimming elements occupy a volume of space near the aperture stop and within the real image of the light source. By locating the color and dimming apparatus near the aperture stop and within the volume occupied by a real image of the light source, superior color mixing, dimming and integration is achieved using simple, unpatterned filters and a simply-shaped dimmer panel. A color filter and dimming system may alternatively be located as close to the light source as possible so that a real image of the color filter and dimming elements is formed near the aperture stop where the image of the light source is formed. The alternate location, forming a real image of the filters and dimmer, is equivalent to locating the actual color filter and dimming elements at the aperture stop. Diffusion glass elements used in a similar apparatus, located at the aperture stop, transform spotlight properties into wash-light properties in a continuously-variable manner.

35 Claims, 8 Drawing Sheets

INTRA-LENS COLOR AND DIMMING APPARATUS

FIELD OF THE INVENTION

The present invention relates generally to stage lighting instruments having associated color-changing mechanisms and particularly to a light source including plural, serial lens elements and selected-wavelength modifiers that are adjustable in the plane of the modifier.

DESCRIPTION OF RELATED ART

Stage lighting instruments having motorized subsytems operated by remote-control means are commonly referred to as "moving lights" or "automated luminaires." Among these are two general varieties: spot luminaires and wash luminaires. Spot luminaires are similar to the "profile spot" or ellipsoidal reflector spotlight commonly used in theaters, and provide a hard-edged beam of light. This kind of spotlight has a gate aperture at which various devices can be placed to define the shape or profile of the light beam and has a projection optical system including one or more objective lens elements. A spot luminaire projects an image of the brightly-illuminated gate aperture, including whatever light-shaping, pattern-generating, or image-forming devices might be placed there. Wash luminaires are similar to the "Fresnel spot" luminaire, which provides a soft-edged, ill-defined beam that can be varied in size by moving the lamp and reflector towards or away from the lens. This kind of wash light has no gate aperture and projects no image, but projects only a soft-edged pool of light shaped by whatever lens or lenses are mounted over the exit aperture of the luminaire.

Color filter systems for automated spot luminaires take advantage of a region near the gate aperture where the diameter of the light beam is small, typically at or near a second focal point of an ellipsoidal reflector, the lamp being located at the first focal point. As in U.S. Pat. Nos. 4,392,187 and 4,800,474 to Bornhorst, small dichroic color filters are mounted on wheels and exchanged in combination to impart a wide variety of vibrant colors to the light beam. The colors are changed step-wise, instantly changing from one color to another.

Color filter systems for automated wash luminaires take advantage of a certain property of dichroic filters to create smoothly changing colors or color cross-fades. As in U.S. Pat. Nos. 4,392,187; 4,602,321; and 5,073,847 to Bornhorst, pivoting dichroic filters vary the angle of incidence of the light beam upon the filter to vary the hue and saturation of color in a continuous fashion. These color filter systems occupy a considerable volume within the luminaire and are not readily adaptable to spot luminaires.

A spot luminaire having a fully cross-fadeable color mixing system that projects a smooth and uniformly-colored beam of light has long been the goal of many lighting manufacturers. Leclerq describes the problem succinctly in U.S. Pat. No. 4,745,531 with respect to traditional gelatin or plastic 'gel' color filters, which are normally placed over the exit aperture of a luminaire downstream of all lens elements. When such a color filter partly intercepts the light beam of a spotlight, only part of the beam is colored—that part of the beam which passes through the filter. The spot of light is then partly colored and partly white. It is desirable to have homogeneous mixing of the colored light and the white light at the projected spot of light. Although Leclerq discloses a color filter apparatus that purports to accomplish this, it is not discernable from the disclosure how this is accomplished.

U.S. Pat. No. 4,894,760 to Callahan, discloses a color-mixing light fixture employing a single, movable, multi-filter array that varies the apparent color of a light beam by additively mixing varying proportions of differently colored light. Callahan attempts to achieve the desired homogeneous mixing of differently colored light by locating the filter array at a "hyperfocal region" between two lens elements, a location in the optical path at which light rays passing through a given point in a plane intersecting the light beam are uniformly distributed across the beam where it illuminates an object. This approach theoretically yields some integration of colors, but experiments have shown that real-world limitations make this a less-than-ideal solution to the problem. For example, the theoretical plane of the "hyperfocal region" has negligible depth along the optical axis of the system thereby making correct location of a co-planar array of color filters very critical. As the filter array moves away from this theoretical plane, the color integration degrades rapidly. Further, real-world limitations of lens design frequently yield aberrations such as field curvature which make the theoretical plane of the "hyperfocal region" non-planar, and thus impossible to use effectively with planar filter elements. Using such a hyperfocal region would require a non-planar filter array precisely placed in a domain of non-planar movement.

U.S. Pat. No. 5,188,452 to Ryan, discloses a color mixing lighting assembly for a spot luminaire including a light source, a color filter set, an objective lens set, and a color mixing channel located between the color filters and the objective lens set. The color mixing channel is a highly-polished, hollow tube of hexagonal or other cross-section having a reflective interior surface. The tube is made of specific diametric and longitudinal dimensions to accomplish color mixing or integration of various primary colors of light. This tubular apparatus is positioned upstream of the aperture gate and necessarily adds length to the overall optical system. The use of such length is frequently preferred for other purposes, such as for zoom optics.

U.S. Pat. No. 5,790,329 to Klaus et al, discloses a color changing device for illumination purposes that provides continuously variable light color using a subtractive color mixing method. Dichroic color filters are introduced into the light path of a spotlight at a place between objective lenses where the illumination field of the lamp is imaged. The image of the light source tends to be relatively large at this location because the diameter of the light beam is large compared to the diameter of the light beam closer to the light source itself, for example; at the aperture gate. This requires that the color filters be large enough to cover the entire beam, which makes for added expense since dichroic filters are themselves rather expensive. Further, experiments have shown that at certain positions of the filters—particularly at around 90% coverage—the color integration is noticeably non-homogeneous with particular distributions of unfiltered white light diluting the saturation of the colored beam over a certain part of the beam. This creates a noticeable, non-homogeneous color effect in a range between fill saturation and pastel shades of color, which is distracting to view and therefore undesirable.

Other techniques disclosed in U.S. Pat. No. 4,914,556 to Richardson; U.S. Pat. No. 5,282,121 to Bornhorst et al; U.S. Pat. No. 5,426,576 to Hewlett; U.S. Pat. No. 5,515,254 to Smith; and U.S. Pat. No. 5,829,868 to Bornhorst et al; require complex patterning of the filter material, continuously-variable hue characteristic filter material, or both. These types of filters are expensive to fabricate and contribute to the high cost of manufacturing an automated luminaire having an associated color changing mechanism.

SUMMARY OF THE INVENTION

It is an object of the invention to provide a simple, cost-efficient color mixing system that projects a smooth and uniformly colored beam of light.

In accordance with one aspect of the present invention, a stage lighting instrument having a high-intensity light source or lamp coupled with a concave reflector, and a projection optical system, further includes a color filter and dimming system located within a lens system that includes a well-defined aperture stop, and forms a real image of the light source near the aperture stop so that the color filter and dimming apparatus occupies a volume of space near the aperture stop and within the real image of the light source. By locating the color and dimming apparatus near the aperture stop and within the volume occupied by a real image of the light source, superior color mixing, dimming and integration is achieved using simple, unpatterned filters and a simply-shaped dimmer panel.

In accordance with another aspect of the present invention, a stage lighting instrument having a high-intensity light source or lamp coupled with a concave reflector, and a projection lens system having a well-defined aperture stop, forms a real image of the light source near the aperture stop, and further includes a color filter system located adjacent the light source so that a real image of the color filter system is formed co-extensively with the real image of the light source at the aperture stop. This is equivalent to locating the color filter system in the volume occupied by the real image of the light source as formed at the aperture stop.

In accordance with a further aspect of the invention, diffusion glass elements included in the color filter system effectively transform spotlight performance into wash-light performance in a continuously-variable manner.

DETAILED DESCRIPTION

Figure 1:
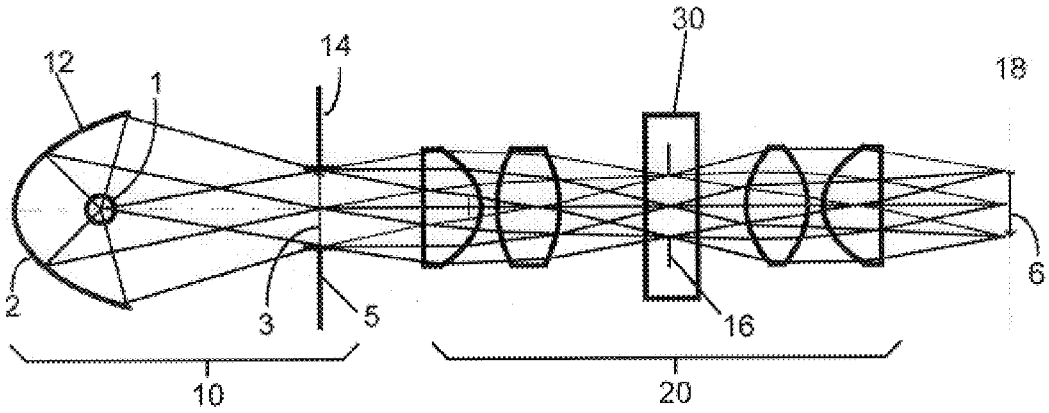
FIG. 1 is a schematic diagram of an illumination optical system including an intra-lens color filter system.

A lighting instrument according to the present invention, as shown in FIG. 1, includes an Illumination System 10, a Relay Lens Group 20 and a Color System 30 located at a certain position within the lens group. The Illumination System 10 includes a Light Source 12 comprising a lamp 1 coupled with a concave reflector 2. The Light Source 12 illuminates an object 3 located at an Object Plane 14, which may simply be an aperture 4 in a field stop plate 5 or may also be a light pattern generator located at the Object Plane 14. The Relay Lens Group 20 relays an image 6 of the brightly illuminated object located at the Object Plane 14, forming said image at an Image Plane 18 some distance downstream of the Relay Lens Group 20. Within the Relay Lens Group 20 lies an Aperture Stop 16 at which the Color System 30 is advantageously located.

Color Mixing and the Aperture Stop

In a first order lens design, two rays are traced through a lens system to determine its performance. These rays, which define a plane within an optical system, are called the chief and marginal rays. As shown in FIG. 2, the chief ray 21 originates at the top of the object 3 and passes through the center of the aperture stop 16, and the marginal ray 22 originates at the center of the object and passes through the edge of the aperture stop 16. Any ray in the plane defined by the chief and marginal rays 21, 22 can be formed from a linear superposition of the chief and marginal rays 21, 22. Therefore, the chief and marginal rays 21, 22 predict the behavior of any ray that propagates in a single plane within the optical system.

FIG. 2 shows a relay lens group with its internal aperture stop 16. Notice that rays passing through any point in the aperture stop 16 are mapped onto the entire object 3 and the entire image 6. Every point in the aperture stop 16 "sees" the entire object 3 and the entire image 6. The aperture stop 16 thus does not limit the size of the projected image. It merely limits the amount of light that propagates through the optical system by limiting the angles of the rays that can pass through the optical system.

Figure 2A:
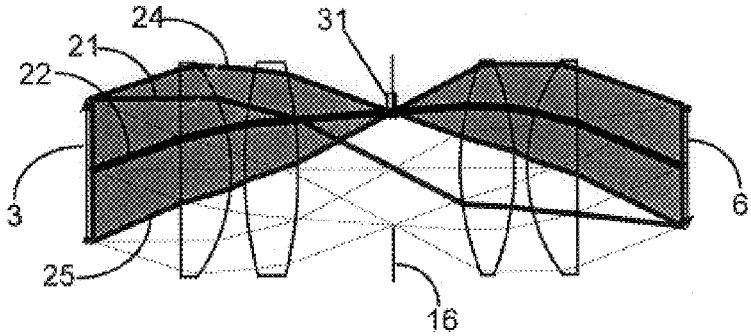
FIGS. 2A–2C are schematic diagrams of a relay lens system illustrating the advantageous action of a color filter located at the aperture stop of the lens system.
Figure 2B:
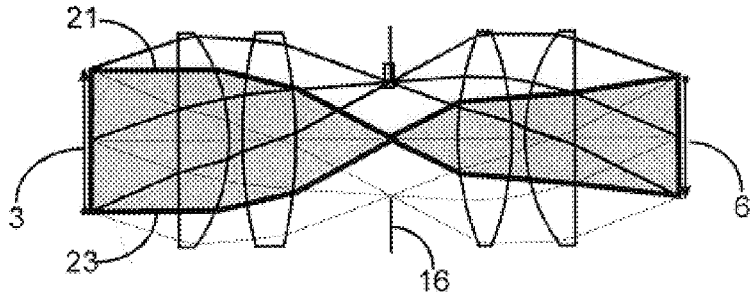
Figure 2C:
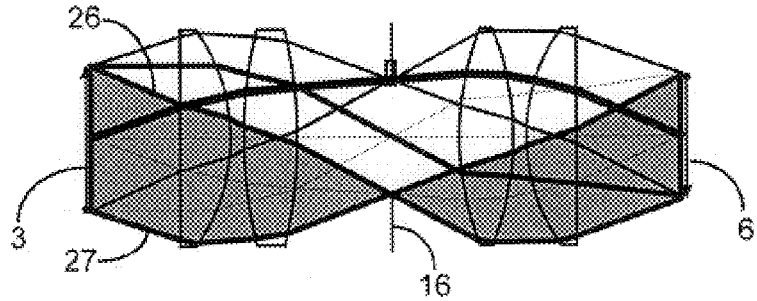

As shown in FIG. 2, three cones of rays pass through the aperture stop 16. An axial cone is bounded by rays 21 and 23 passing through vertex lying at the center of the aperture stop 16 (FIG. 2B). A top cone is bounded by rays 24 and 25 passing through a vertex lying at the top of the aperture stop 16 (FIG. 2A). A bottom cone is bounded by rays 26 and 27 passing through a vertex lying at the bottom of the aperture stop 16 (FIG. 2C). Three images covering the entire projected image may be formed from the rays bounded by the three cones. Each of the three cones has a vertex that lies within the aperture stop 16. If a color filter 31 is placed at the vertex of the top ray cone, the rays passing through this point produce an image that is colored throughout the image. The light passing through the other two vertices produces a pair of white images. The three images lie on top of each other and the complete image appears tinted, but not fully saturated. The purity or saturation of the final image color depends on the percentage of the aperture stop that is covered by the color filter. Thus, the aperture stop 16 is well suited as a location for a color mixing system.

Figure 3:
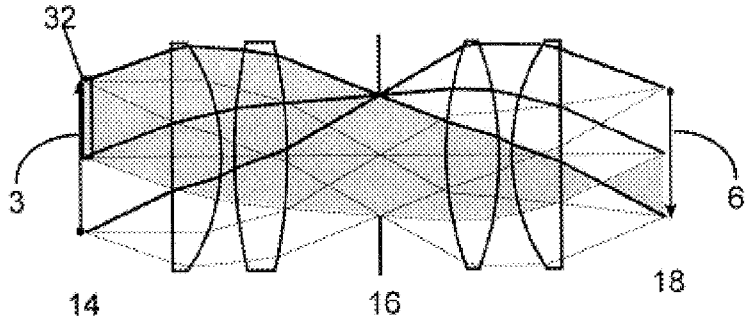
FIG. 3 is a schematic diagram of a relay lens system illustrating the disadvantageous action of a color filter located at the object plane of the lens system.

For comparison, FIG. 3 shows a color filter 32 placed over the top half of the object. This produces a two color image. The colored portion of the image has the characteristics of the color filter, and the uncolored portion is white. As one would guess, FIG. 2 and FIG. 3 illustrate both extremes of this situation. Placing the color filter in any plane other than the aperture stop plane results in an image with non-uniform color. The degree of non-uniformity increases as the distance from the aperture stop 16 increases.

Practical Considerations

Laboratory work has shown that placing the color system near the aperture stop works reasonably well. However, the uniformity of the colored image also depends on the lens design, and on the illumination system used to convey light to the object. In particular, aberrations in the lens interfere with the color integration of the projected beam. These practical limitations have made it impossible to attain suitable color integration by simply placing color filters near the aperture stop. However, acceptable integration is attained by patterning the color filter material on the glass substrate. Such variable density CYM color mixing systems are well known, but such patterned color filters are undesirably expensive. Therefore, another method of attaining acceptable integration is desired.

Traditional Projector Optics

Figure 4:
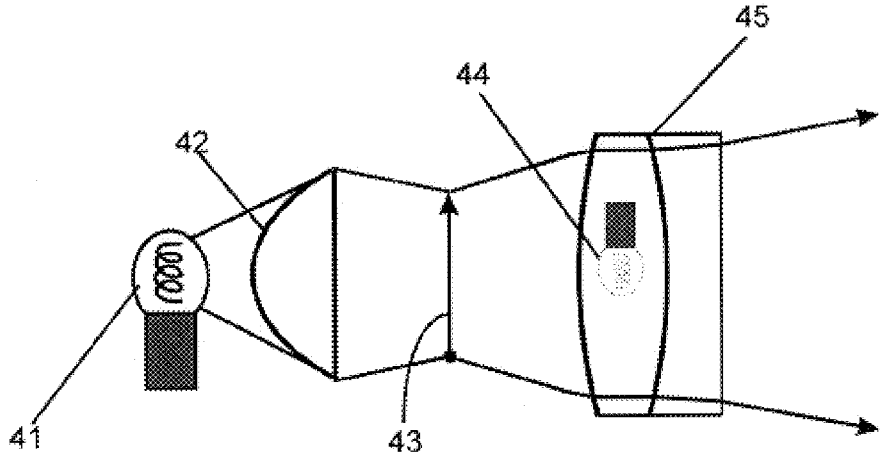
FIG.4 PRIOR ART
FIG. 4 is a schematic diagram of a first prior art projector optical system.

FIG. 4 shows a traditional slide projector system. Here, light radiating from lamp 41 is collected by a condenser lens 42 and directed through a film gate 43. The system is designed so that an image 44 of the lamp 41 is located within a projection lens 45. The lamp filament is therefore not visible in the projected beam, and any irregularity in the light source simply decreases the amount of light on the wall.

Spot Luminaire Projection System Design

Figure 5:
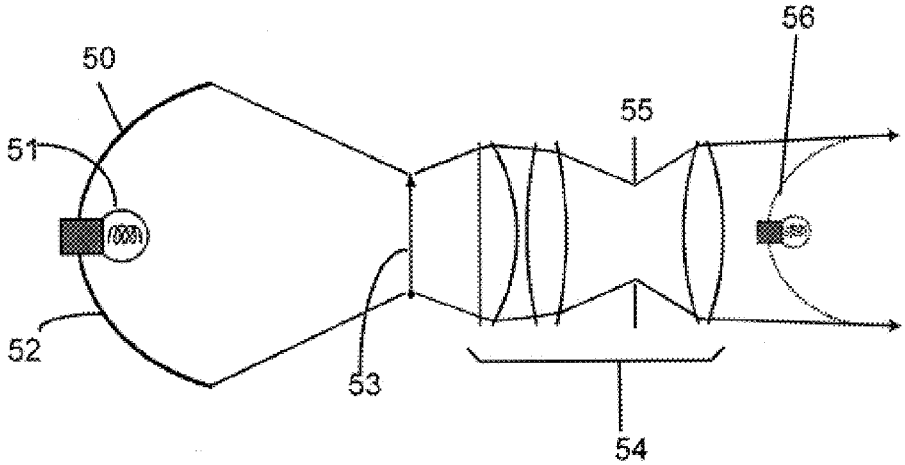
FIG.5 PRIOR ART
FIG. 5 is a schematic diagram of a second prior art projector optical system.

FIG. 5 shows a typical spot luminaire projection system. A light source 50 comprising a lamp 51 and a concave reflector 52 directs light rays onto an object 53, and the three-element projection lens system 54 then produces an image (not shown) of the object on a remotely located screen. Typically, the distance to the screen is 20 feet or more.

The projection lens 54 also produces an image 56 of the light source 50. Here, the term "light source" refers to the reflector 52 and the lamp 51. Since the light source 50 is located behind the object 53, the light source image 56 is located between the luminaire and the screen. Often, the light source image is located near the luminaire, as shown in FIG. 5.

The volume occupied by the light source image contains the most disordered distribution of light in the entire optical train. However, this disorder is not mapped onto the final projected image. The object is illuminated with a smooth distribution of light, and the image is illuminated with a smooth distribution of light.

Experimental results have demonstrated that placing the color mixing system within the volume occupied by the light source image produces a projected beam with very uniform color. This effect can be easily explained by recalling what this image of the light source represents in a lens system designed in accordance with the invention. The image of the light source is a real image as opposed to a virtual image. Therefore, placing a colored filter at this location is equivalent to placing the colored filter on the surface of the light bulb.

Figure 6:
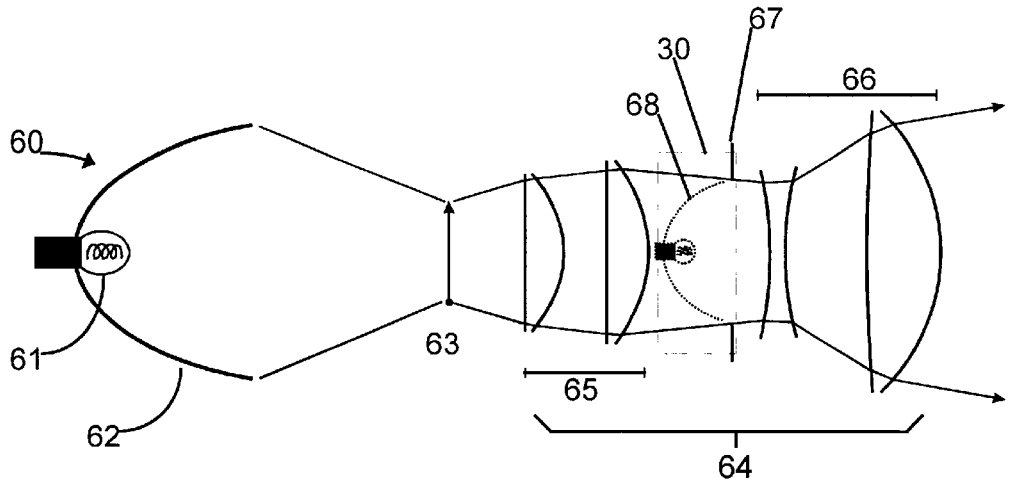
FIG. 6 is a schematic diagram of a projector optical system according to the present invention.

All optical images are produced at a distance that depends on the object's distance from the lens and the lens' focal length. FIG. 6 shows a light source 60 comprising a lamp 61 and a reflector 62, an object 63, such as a film gate illuminated by the light source, and a lens system 64 comprising two lens groups 65 and 66, each having positive optical power. An aperture stop 67 is located between the two lens groups. A real image 68 of the light source 60 is formed adjacent the aperture stop 67 due to the location of the light source and the focal length of the first lens group 65.

Figure 7:
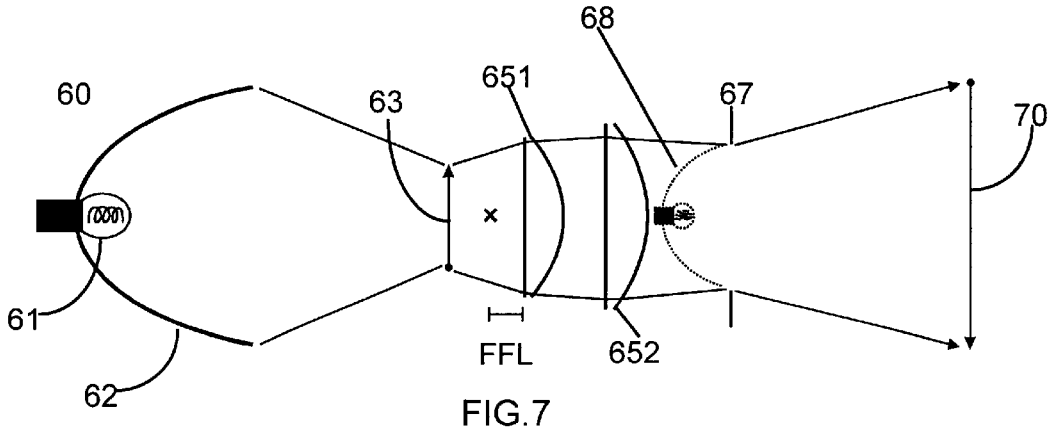
FIG. 7 is a schematic diagram of a first lens group according to the present invention.

The first lens group 65, as shown in FIG. 7, has a short front focal length (FFL). The light source 60 and the projection gate 63 lie outside the FFL. Therefore, the first lens group 65 forms real images 68 and 70 of both the light source and the projection gate. Lenses 651 and 652 in the first lens group are designed with the proper materials, curvatures, thicknesses and spacings to place the real image 68 of the light source 60 between the last lens element 652 in the first lens group and the aperture stop 67. Lenses in the first lens group are furthermore designed to place the real image 70 of the projection gate 63 outside the aperture stop 67, typically 10 to 20 feet beyond the aperture stop.

Figure 8:
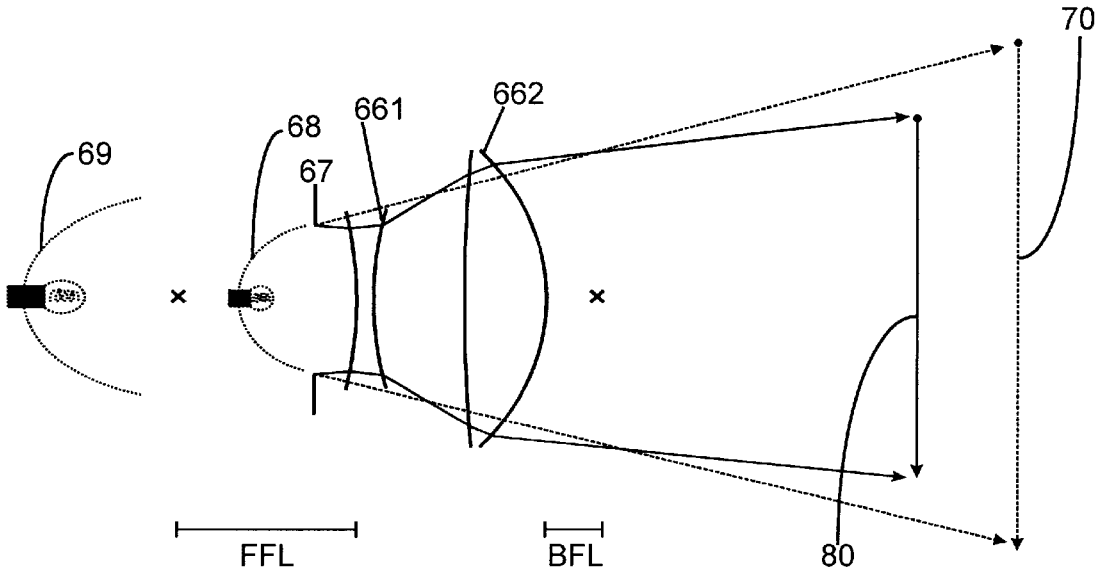
FIG. 8 is a schematic diagram of a second lens group according to the present invention.

The second lens group 66, as shown in FIG. 8, is designed so that the real image 68 of the light source 60 formed by the first lens group 65 lies within the FFL of the second lens group 66, and so that the real image 70 of the projection gate 63 formed by the first lens group 65 lies outside the back focal length (BFL) of the second lens group 66. Since the second lens group 66 has positive optical power and the real image 68 of the light source 60 lies within its FFL, the second lens group consequently forms a virtual image 69 of the light source. This virtual image 69 of the light source 60 is located within the luminaire upstream of the real image 68 formed by the first lens group 65 and can only be viewed by looking into the luminaire through the lens system. Since the real image 70 of the projection gate 63 formed by the first lens group 65 lies far outside the BFL of the second lens group 66, this image 70 acts as a virtual object for the second lens group, which consequently forms a real image 80 at the correct location and magnification. Therefore, the second lens group 66 forms a virtual image 69 of the light source 60, which is not projected, and a real image 80 of the projection gate 63, which is projected. The second lens group 66 works in conjunction with the first lens group 65 to form an image 80 of the projection gate 63 at the proper distance from the luminaire and with the desired magnification.

It is thus possible, through design, to force the image of the light source to lie within the lens train directly before or after the lens' aperture stop. A color filter system is placed in this location. In such a lens design, both the integration that occurs in the aperture stop and the integration that occurs within the volume occupied by the light source image are utilized. These two effects, when combined, produce superior color mixing in a spot luminaire. Experimental testing has demonstrated highly uniform color mixing with this lens system.

Color System Design

Since every point in the aperture stop sees every point in the object plane and every point in the image plane, any filtering material introduced into the relay lens system at the aperture stop is integrated over the entire aperture at the image plane. Thus, a colored and/or dimmed image of the brightly illuminated aperture in the illumination system is projected on the screen. Due to the inherent integration of filtering materials introduced at the stop in the relay lens group, complex integrated patterns of filtering media as shown in U.S. Pat. No. 4,914,556 are not required.

Figure 9:
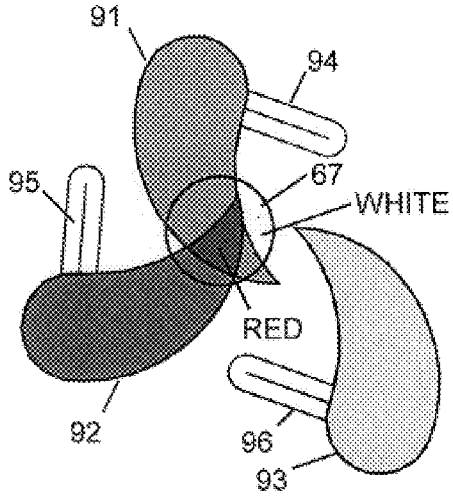
FIG. 9 is a pictorial representation of a CYM (cyan yellow magenta) color mixing system.

A well designed projection system allows placing color filters near the lens stop, and within the volume occupied by the light source image. The result is superior color mixing of the projected beam without the need to pattern the color filter material. FIG. 9 shows one possible CYM color mixing system 30 of FIG. 1. Here the filters 91, 92, and 93 are finger shaped. Each filter is mounted to an arm 94, 95, and 96, respectively, which, in turn, is mounted to a motor (not shown). The motors are mounted to a plate containing the aperture stop 67. As each filter is rotated into the beam, it colors a portion of the rays passing through the lens' aperture stop. Smooth color mixing of the image is achieved without the need to pattern the color filter material. Since the filters are located within the volume occupied by the light source image, the edges of the filters are not visible as the filters pass through the beam.

Dimmer Configuration

Figure 10:
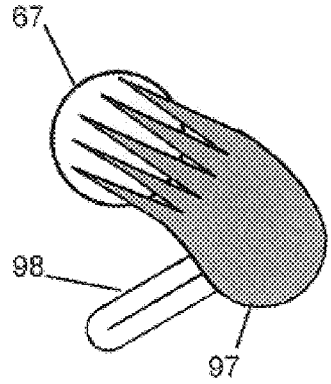
FIG. 10 is a pictorial representation of a mechanical light dimmer.

It is possible to place a dimmer at this location, as well. The dimmer works on the same principle as the color filter, except that it blocks the light rather than coloring it. Like the color filters, the dimmer is located near the lens' aperture stop and within the volume occupied by the light source image. Therefore, the edges of the dimmer are not visible in the projected beam and the dimmer merely controls the amount of light present in the projected beam. FIG. 10 shows a claw shaped dimmer 97 mounted to the plate containing the aperture stop 67.

One difficulty encountered with the system shown in FIG. 9, as combined with FIG. 10, is that the single claw dimmer 97 tends to block filtered light from one side of the aperture stop first and progressively blocks light from the other side of the stop as the dimmer moves across the stop. This action tends to vary the color of projected light as the dimmer blocks first one color filter and then progressively blocks the other color filters. The variation in color would become particularly noticeable during a slow fade-out. A reverse situation occurs as the dimmer blade is progressively removed from the aperture stop, such as during a slow fade-in for example, when the variation in color during the fade-in would again become noticeable.

In a preferred embodiment, two or more dimmer blades are mounted evenly spaced around the beam path and actuated for coordinate movement into or out of the beam path. Two dimmer blades can be mounted opposing each other across the beam path, or three dimmer blades can be mounted spaced 120 degrees around the beam path. A greater number of dimmer blades might also be used, with the blades mounted evenly-spaced around the beam path. Plural, evenly-spaced dimmer blades block filtered light from each of the color filter sets equally so as not to disturb or vary the color balance while dimming.

Linearly Actuated Color Filters and Dimmer

Figure 11:
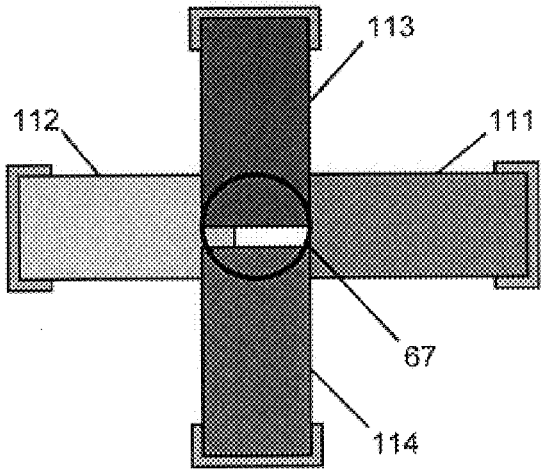
FIG. 11 is a pictorial representation of an alternate color mixing system with mechanical light dimmer.

Using the same principles described above with reference to FIG. 9, a color filter and dimmer mechanism can also be operated by linear actuator stepper motors as shown in FIG. 11. A cyan filter 111, a yellow filter 112, a magenta filter 113, and a green filter 114 are arranged about an aperture stop 67 in a relay lens system. The color filters blade may be orthogonally arranged, although other arrangements are possible. Each color filter is progressively introduced into or withdrawn from the aperture stop by action of a reversible electric motor, preferably a linear actuator stepper motor, to color the beam of light as described above.

Figure 12:
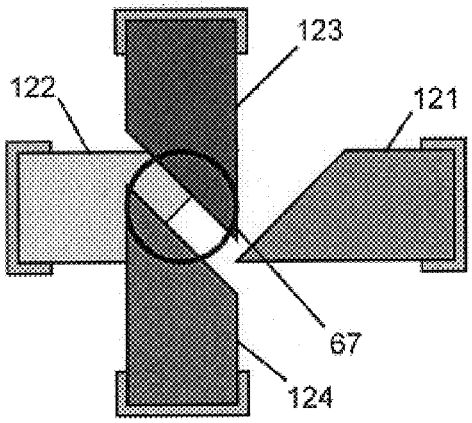
FIG. 12 is another pictorial representation of a color mixing system with mechanical light dimmer.
Figure 13:
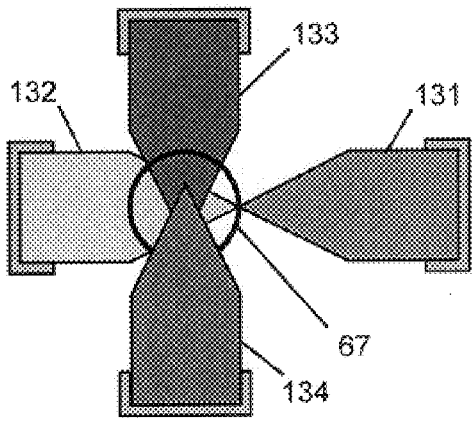
FIG. 13 is yet another pictorial representation of a color mixing system with mechanical light dimmer.

As shown in FIG. 12 and in FIG. 13, the color filters may embody different shapes, which can be designed to control the area covered by the filters in proportion to the distance moved, or to control the extent by which the color filters overlap in proportion to the distance moved. Regardless of the specific configuration of the filters and the dimmer, the projected image will have a fully blended homogeneous color. The actual shade and intensity of the image is dependent on the area of the aperture occupied by the filters and the dimmer. FIG. 12 shows a cyan filter 121, a yellow filter 122, a magenta filter 123, and a green filter 124 arranged orthogonally about an aperture stop 67 in a relay lens system. FIG. 13 shows a cyan filter 131, a yellow filter 132, a magenta filter 133, and a green filter 134 arranged orthogonally about an aperture stop 67 in a relay lens system. The principles of color filtering at the aperture stop are thus independent of any specific actuator means or specific filter shape.

Figure 14:
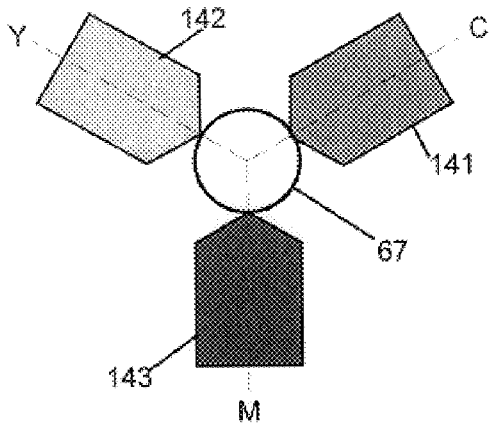
FIGS. 14–21 are pictorial representations of other color filter systems.
Figure 15:
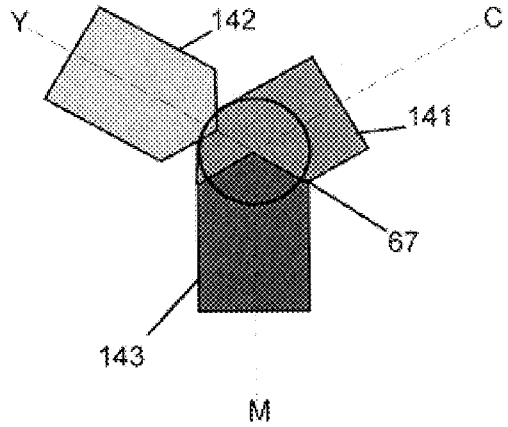

Another CYM color mixing system 30, as shown in FIG. 14 and FIG. 15, may be used in conjunction with a dimming iris (not shown) to obtain both additive and subtractive color filtering. A cyan filter 141, a yellow filter 142, and a magenta filter 143 are arranged radially around the aperture stop 67 as shown in FIG. 14. The filters can be mounted in a translation mechanism, as described above, so that each color filter is progressively introduced into or withdrawn from the aperture stop by action of a reversible electric motor. The color filters are arranged symmetrically, 120° apart, about an optical axis passing through the center of the aperture stop. Each filter is pointed on the leading portion so that two leading edges are formed with an angle of 120° formed between the two leading edges. In this way, it is possible for each filter to cover one-third of the aperture stop without overlapping any other color filter. As any one of the three filters is withdrawn from the aperture stop, its effect on the resultant color of the light beam passing through the stop is reduced and unfiltered white light is added to the mix of the remaining two colors. This produces a variable additive color filtering effect. Each filter is also large enough to cover the entire aperture stop and, as any two or more filters are extended further into the stop, the filters overlap to varying degrees, thereby producing a variable subtractive filtering effect. As shown in FIG. 15, for example, the cyan filter 141 completely covers the aperture stop 67, the magenta filter 143 overlaps the cyan filter and covers one-third of the aperture stop, and the yellow filter 142 overlaps the cyan filter in a plane between the cyan and magenta filters, but is only covering a negligible portion of the aperture stop. This produces a combination of additive and subtractive filtering effects where approximately two-thirds of the light is cyan and the remaining third is the subtractive result of cyan-magenta filtering. These two color areas are integrated by the above-described effect of locating the color filters in the volume occupied by a real image of the light source at the aperture stop of the lens system.

Figure 16:
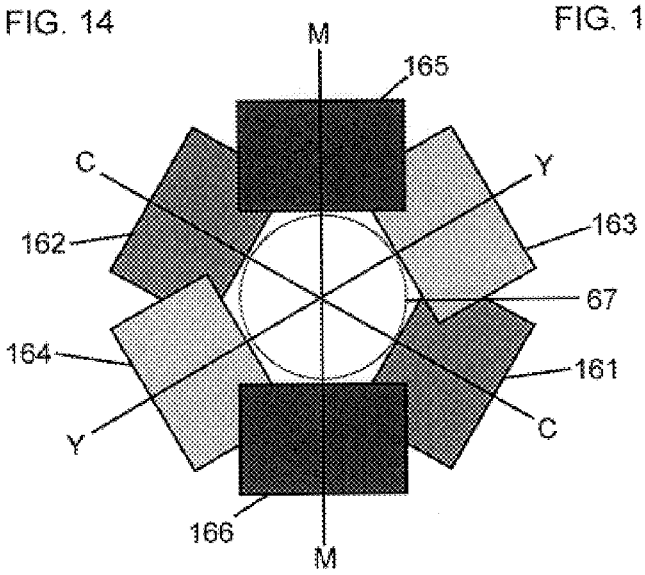
Figure 17:
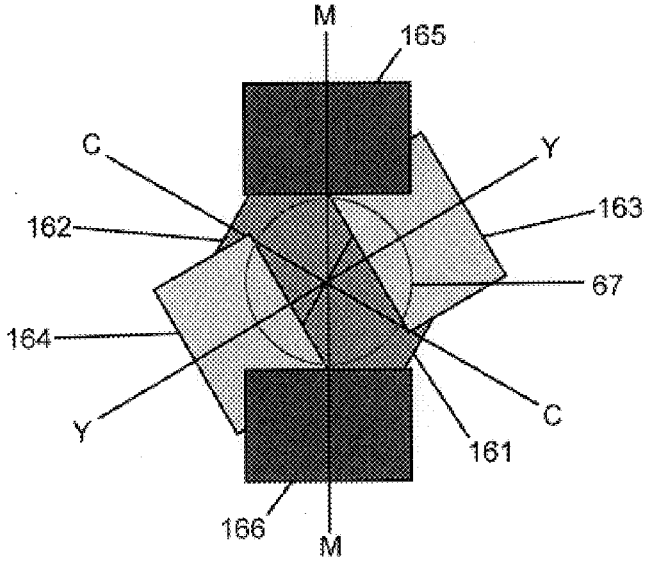

Another CYM color mixing system 30, as shown in FIG. 16 and FIG. 17, may also be used in conjunction with a dimming iris (not shown). As shown in FIG. 16, two magenta filters 165 and 166 are arranged on opposite sides of the aperture stop 67 and are mounted in a translation mechanism operable to move the filters into or out of the stop in a coordinated manner along an axis M—M. Two cyan filters 161 and 162 are also arranged on opposite sides of the aperture stop 67 and are mounted in a translation mechanism operable to move the filters into or out of the stop in a coordinated manner along an axis C—C. Two yellow filters 163 and 164 are also arranged on opposite sides of the aperture stop 67 and are mounted in a translation mechanism operable to move the filters into or out of the stop in a coordinated manner along an axis Y—Y. Each of the axes M—M, C—C, and Y—Y are arranged 120° apart around the optical axis passing through the center of the aperture stop 67. As shown in FIG. 17, each pair of color filters is introduced into the stop by equal amounts; for example, the cyan filters 161–162 are shown completely covering the stop, the yellow filters 163–164 are shown each covering equal portions of the stop, and the magenta filters 165–166 are shown each at the edge of the stop. As can be seen, the cyan filter 161–162 pair is at the rear of the filter system, with the yellow filter 163–164 pair in the middle and the magenta filter 165–166 pair at the front. The two filter panels in each pair of filters are preferably co-planar, but the filter pairs themselves are preferably arranged in sequence to allow the filter pairs to overlap. This symmetrical arrangement of filter pairs helps to further reduce color non-homogeneity at the extremes of filter travel. An iris-type color changer, such as shown by Solomon in U.S. Pat. No. 4,811,182, can also be used.

Figure 18:
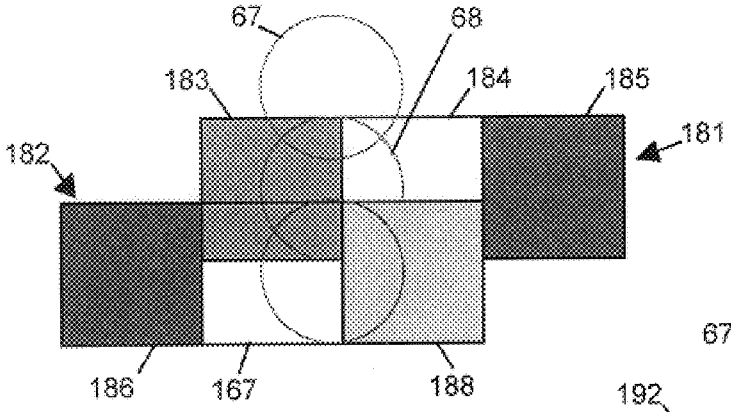

Another CYM color mixing system 30, as shown in FIG. 18, includes two glass slides 181 and 182 having color filtering material on either end and a clear area in the middle. The glass slides are arranged sequentially, one behind the other, and are mounted in a translation mechanism operable to move the slides independently and from side-to-side across the beam path through the aperture stop 67 and within the volume occupied by the image 68 of the light source. The first slide 181 includes a cyan filter 183 on one end and a magenta filter 185 on the other end, with a clear area 184 in the middle. The second slide 182 includes a magenta filter 186 on one end and a yellow filter 188 on the other end, with a clear area 187 in the middle. A particular advantage of this arrangement is that equal amounts of glass are always in the optical system regardless of the positions of the color filters. This may improve the quality of a projected image in certain situations in which the lens system is particularly sensitive to the cumulative thicknesses of glass in the system. The operation of the system is similar in some ways to the scrolling primary color changer disclosed by Richardson et al in U.S. Pat. No. 5,126,886; but in the present case, the filters have no gradient axis as shown by Richardson et al. Color integration is not accomplished by varying the saturation of the color filter as shown by Richardson, but is accomplished instead by the combined effect of locating color filters within the volume occupied by an image of the light source positioned at the aperture stop of a lens system.

Figure 19:
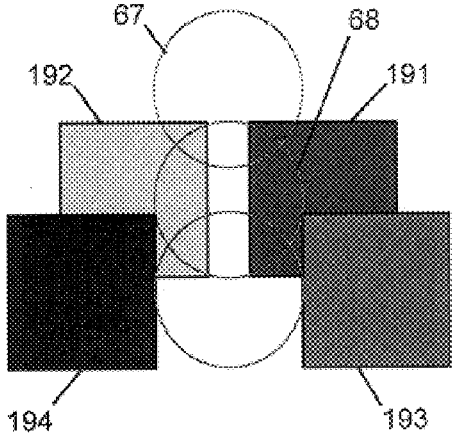

Another color mixing system 30 shown in FIG. 19 includes four, independently movable color filter plates 191–194 colored red, yellow, green and blue respectively. These operate in the manner described by Ryan in U.S. Pat. No. 5,188,452; although in this case the color mixing channel described by Ryan is not required owing to the "free" integration afforded by the particular optical design of the present invention. This additive system provides for smooth color cross-fades from red through yellow and green, to blue and provides for variable saturation depending upon the spacing between the filters. In the example shown in FIG. 19, the red filter 191 and yellow filter 192 each partially intercept the light beam within the volume occupied by the real image 68 of the light source 60 and a certain portion of unfiltered white light is passed between the filters.

Figure 20:
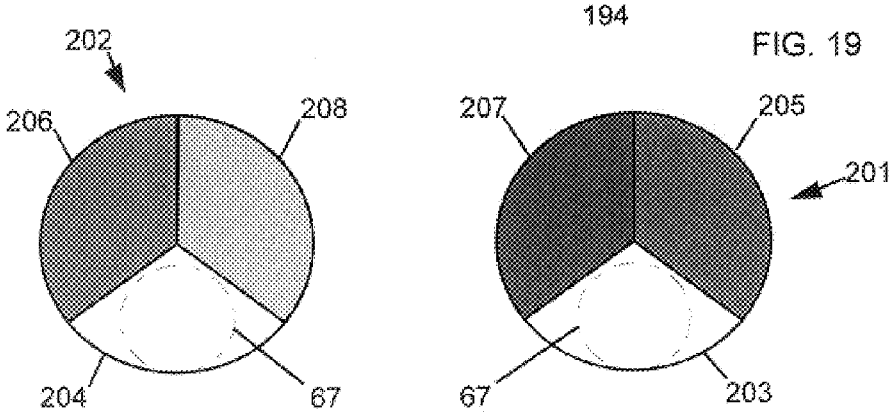

A color mixing system 30 comprising two, sequentially mounted filter disks 201 and 202, shown in FIG. 20, can also be used to advantage in the volume occupied by a light source image at the aperture stop of a lens system. Here, each filter disk includes two filter areas and a clear area. A first disk 201 includes, for example, a cyan filter 203 and a yellow filter 204 plus a clear area 205. A second disk 202, for example, includes a magenta filter 206 and a green filter 207 plus a clear area 208. The two disks can be mounted in any overlapping manner so long as part of each disk can cover the entire diameter of the aperture stop 67 and that part being located within the volume of the light source image 68. The disks can be rotated singly or in combination to place any proportional combination of filter or clear areas in the beam path. Some additive and subtractive filtering effects are possible with this arrangement. For example, cyan-yellow additive combinations in varying proportions together with magenta or green subtractive filtering effects can be achieved.

Figure 21:
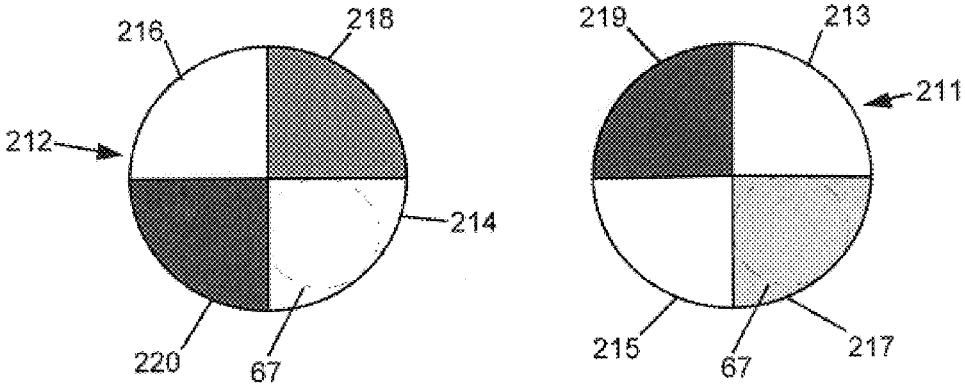

Another color mixing system 30 comprising two, sequentially mounted filter disks 211 and 212, shown in FIG. 21, can also be used to advantage in the volume occupied by a light source image at the aperture stop of a lens system. Here, each filter disk includes two filter areas and two clear areas. A first disk 211, for example, includes a cyan filter 213 and a magenta filter 214 plus two clear areas 215–216. A second disk 212, for example, includes a yellow filter 217 and a magenta filter 218 plus two clear areas 219–220. Since each filter area is bounded on both sides by a clear area, it is easy to rotate either disk in either direction to vary the relative saturation of any of the filters. Additive and subtractive combinations are possible; for example, the cyan filter 213 can cover half the aperture stop 67 diameter while the yellow filter 217 covers the other half, or the cyan filter 213 can cover three-fourths of the aperture stop diameter while the yellow filter 217 overlaps the cyan filter to some extent leaving the remaining one-fourth of the aperture stop clear.

Pivotally-actuated Color Filters and Dimmers

Figure 22:
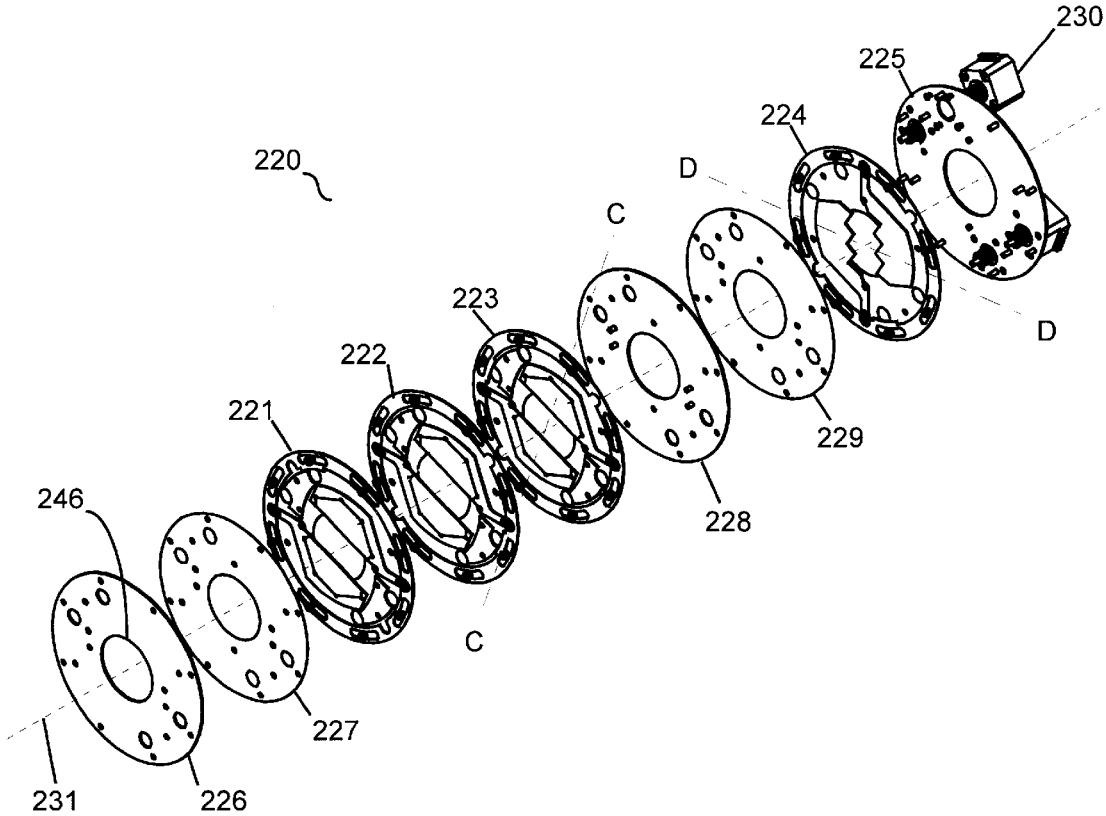
FIG. 22 is a pictorial representation of another color mixing system with mechanical light dimmer.

The color filter systems shown in FIGS. 11–17 and in FIG. 19 can also be operated in a pivotally-actuated fashion as shown, for example, in FIG. 9 and FIG. 10. In particular, a system similar to that shown in FIG. 16 and FIG. 17 can be adapted for pivotal movement of the filters with opposing filters of the same color moving coordinately into or out of the beam. As shown for example, in FIG. 22, three sets of color filters, a cyan filter mechanism 221, a yellow filter mechanism 222, and a magenta filter mechanism 223, can be combined in an apparatus with a dimmer mechanism 224. In a practical apparatus such as shown here, a motor plate assembly 225 supports a plurality of electric motors 230 for actuating the filter and dimmer mechanisms. Dimmer mechanism 224 is mounted to motor plate assembly 225 and secured by suitable fasteners. A spacer 229 separates the dimmer mechanism 224 from a plate 228. Filter mechanisms 221, 222, and 223 are mounted to the plate 228. Another spacer 227 separates the filter mechanisms from a plate 226. The various mechanisms, plates and spacers 221–229 are secured together by suitable fasteners to form a compact apparatus 220 having a small longitudinal dimension along an optical axis 231. Each plate, spacer and mechanism 221–229 includes a central aperture 246 which is concentric with the central apertures of the other plates, spacers or mechanism, and all of the central apertures are aligned with the optical axis.

Figure 23:
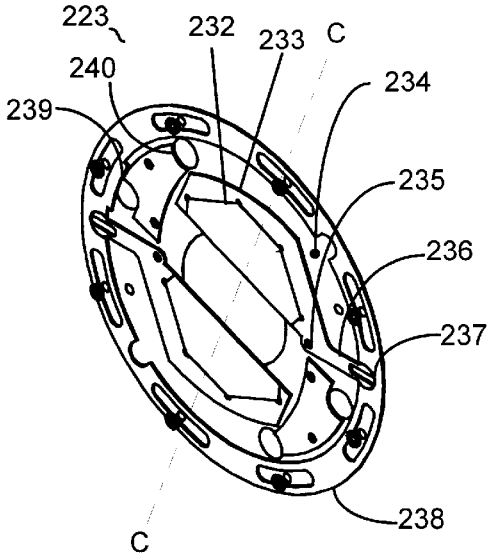
FIG. 23 is a pictorial representation of a color filter mechanism.
Figure 24:
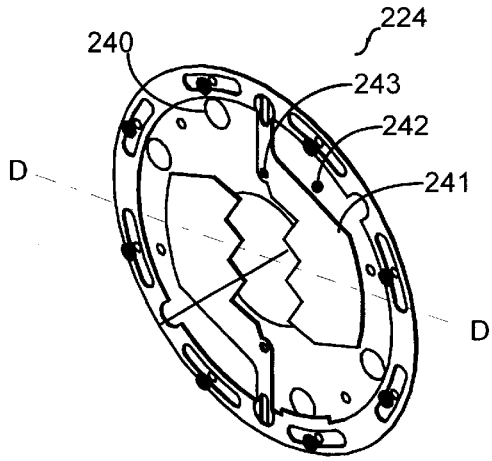
FIG. 24 is a pictorial representation of a mechanical light dimmer mechanism.

A representative color filter mechanism 223 is shown in FIG. 23 while the dimmer mechanism 224 is shown in FIG. 24. Here, the filters are oriented along a color axis C—C while the dimmer blades are oriented along a dimming axis D—D. Dimming axis D—D is preferably orthogonal to the color axis so that the dimmer blades block the pairs of color filters equally. Each color filter element 232 is supported in a pivoting holder 233 secured to a support plate 234 at a pivot pin 235. An actuating arm portion 236 of the pivoting holder engages a slot 237 in a peripheral drive ring 238. Internal gear teeth 239 are formed in the drive ring for engagement with a drive gear (not shown). Holes 240 formed in the support plate 234 permit drive gears for each of the filter and dimmer mechanisms to pass through the plates for engaging the appropriate drive rings at their internal gear teeth. The drive ring for each of the filter and dimmer mechanisms is assembled onto the mechanism in a particular orientation so the internal gear teeth engage the appropriate drive gear. In this way, each of four motors 230 mounted on motor plate assembly 225 actuates only one of the mechanisms 221–224.

Dimmer mechanism 224, as shown in FIG. 24, is similar to the filter mechanisms 221–223 and operates in the same way. Instead of color filter elements mounted in a pivoting holder, the dimmer mechanism includes a pair of opaque dimmer blades 241 secured to a support plate 242 at pivot pins 243. The support plate is oriented so that the motion of the dimmer blades 241 is orthogonal to the motion of the color filter elements with respect to the optical axis 231.

Figure 25:
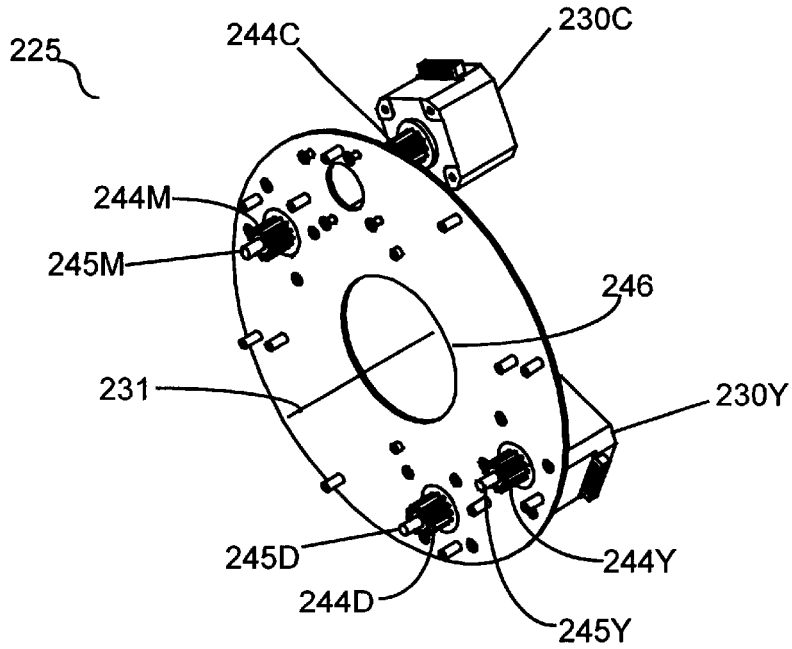
FIG. 25 is a pictorial representation of a motor plate assembly.

Motor plate assembly 225 shown in FIG. 25 includes four electric motors 230C, 240Y, 240M and 240D, each motor having a corresponding drive gear 244C, 244Y, 244M or 244D mounted to a motor shaft 245C, 245Y, 245M or 245D. The motors can be energized by any means, but preferably an electronic control system is employed for operating the filter and dimmer mechanisms by remote control.

Alternate Placement of Color Filters and Dimmer

Color filters placed at the aperture stop of a relay lens system may exhibit back reflections of undesired color into the illumination system, particularly when dichroic, interference filters are used as the color filter elements. If a light pattern generator is placed at the Object Plane, the back reflections from the color filters might be reflected forwards again, imaged by the lens system and projected to the Image Plane, thereby degrading the desired image with stray, unwanted color. Since light pattern generators are typically made of a reflective material to minimize thermal absorption, re-reflection of such back reflections is difficult to avoid without further processing of the light pattern generator, such as by placing a dark mirror or other anti-reflective surface treatment on one side thereof.

Figure 26:
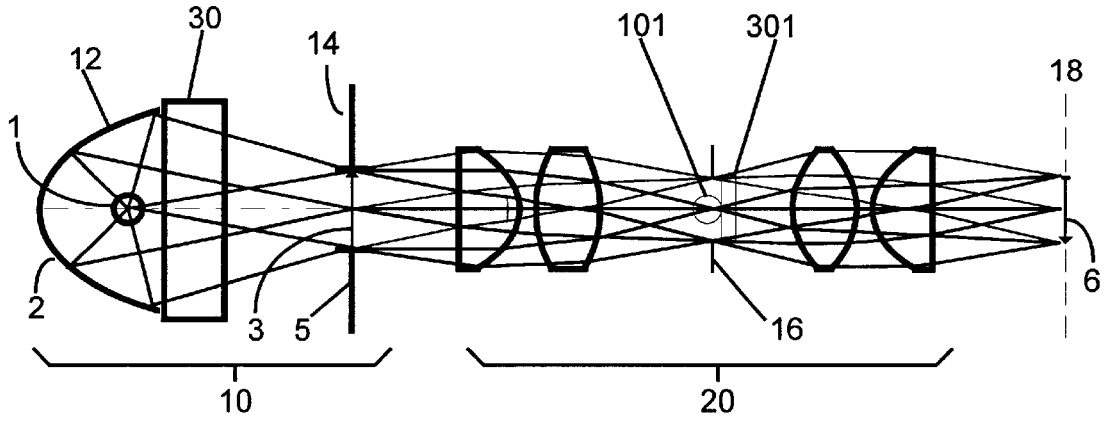
FIG. 26 is a schematic diagram of another illumination optical system including a color filter system.

The problems associated with back reflections from the color filters are eliminated when, as shown in FIG. 26, the color system 30 is located directly in front of the reflector 12. In this position, all back reflections return to the light source 1 and only the desired color light illuminates the object 3 located at object plane 14. In this position, a real image 301 of the color filters forms at aperture stop 16, and lies next to the real image 101 of the light source, which is also formed at aperture stop 16. This is equivalent to placing the actual filters at the aperture stop 16, and all the same advantageous color mixing still occurs as described previously. Dimmer blades included in the color system mechanism at this location in front of the reflector also obtain the same equivalent advantages as the color filters. Moreover, placement of the color filters at the position in front of the reflector is not as critical as within the lens system; the filters need not be precisely normal to the optical axis nor parallel to each other, and longitudinal placement along the optical axis is not as critical.

Other Uses of the Principles

Laboratory work has also shown that diffusion glass or other diffusion elements can be used instead of, or in addition to, color filters or dimmer blades to achieve additional effects. Textured glass panels, such as described for example in U.S. Pat. No. 4,972,306, can be used in an apparatus similar to the color filter and dimmer mechanisms described herein, and function to change the properties of an illumination stage light from that of a spot light to that of a wash light. When such diffusion glass is introduced into the path of the light beam where an image of the light source is formed, the image-forming quality of the light beam is progressively disrupted so that a hard-edged spot of light projected by the stage light is transformed into an ill-defined pool of light characteristic of a wash light. At intermediate positions of a diffusion element mechanism, some image-forming quality of the stage light yet remains, although the peripheral portions of the light beam assume more of the wash-light quality. This intermediate property and other dynamic properties of such a diffusion apparatus, especially a motorized apparatus, can be used for artistic effect.

The various color mixing systems shown in one aspect of the invention are positioned near the aperture stop of a projection lens system. The lens is designed so that a real image of the light source occupies the same volume as that of the color mixing system. The color filters are composed of unpatterned color filter material deposited on simply-shaped substrates. As the filters are moved into the path of the light beam, their edges are not visible and the projected image is evenly colored. A mechanical dimmer can be placed in this location as well.

In another aspect of the invention, color mixing systems are positioned directly in front of a light source and reflector combination, and a real image of the color filters overlies a real image of the light source near the aperture stop of a projection lens system. The color filters are composed of unpatterned color filter material deposited on simply-shaped substrates. As the filters are moved into the path of the light beam, their edges are not visible and the projected image is evenly colored. A mechanical dimmer can be placed in this location as well. This is equivalent to placing the color and dimming system at the aperture stop of the lens system, and the same advantageous color mixing occurs.

The color mixing system is well-suited for placement in the path of a high-intensity beam of light for illuminating a light pattern generator, gobo or an image generator system. The color mixing system can also be used independently in any stage lighting instrument having a relay lens system with a well-defined aperture stop.

Although specific embodiments of the present invention are disclosed, these are not to be construed as limiting the scope of the present invention. Many variants of the invention will become apparent to those skilled in the art in light of this specification. The scope of the invention is only limited by the claims appended hereto.

What is claimed is:

1. A lighting instrument comprising:

a light source projecting a beam of light;

a projection optical system including at least two lens elements and having an aperture stop, said optical system forming an image of said light source at a location contiguous to said aperture stop; and a color filter apparatus supporting at least two independently movable color filter elements, said color filter apparatus being located near said aperture stop in a volume of space occupied by said image of said light source, said color filter elements being supported for movement across said beam of light.

2. A lighting instrument as defined in claim 1, further including a motor-drive apparatus connected to each of said movable color filter elements.

3. A lighting instrument comprising:

a light source projecting a beam of light;

a projection optical system including at least two lens elements and having an aperture stop, said optical system forming an image of said light source at a location contiguous to said aperture stop; and a movable dimmer element located near said aperture stop in a volume of space occupied by said image of said light source.

4. A lighting instrument as defined in claim 3, further including a motor-drive apparatus connected to said movable dimmer element.

5. A lighting instrument comprising:

a light source projecting a beam of light;

a projection optical system including at least two lens elements and having an aperture stop, said optical system forming an image of said light source at a location contiguous to said aperture stop; and one or more movable diffusion elements located near said aperture stop in a volume of space occupied by said image of said light source.

6. A lighting instrument as defined in claim 5, further including a motor drive apparatus connected to said movable diffusion elements.

7. A lighting instrument comprising:

a light source projecting a beam of light;

a projection optical system including at least two lens elements and having an aperture stop, said optical system forming an image of said light source at a location contiguous to said aperture stop; and a color filter apparatus supporting at least two independently movable color filter elements, said color filter apparatus being located near said light source, said color filter elements being supported for movement across said beam of light, and said optical system forming an image of said color filter elements at a location contiguous to said aperture stop.

8. A lighting instrument as defined in claim 7, further including a motor-drive apparatus connected to each of said movable color filter elements.

9. A lighting instrument comprising:

a light source projecting a beam of light;

a projection optical system including at least two lens elements and having an aperture stop, said optical system forming an image of said light source at a location contiguous to said aperture stop; and a movable dimmer element located near said light source, said dimmer elements being supported for movement across said beam of light, and said optical system forming an image of said dimmer elements at a location contiguous to said aperture stop.

10. A lighting instrument as defined in claim 9, further including a motor-drive apparatus connected to said movable dimmer element.

11. A lighting system comprising:

a light source projecting a beam of light;

a first lens group having at least one lens element receiving the projected light such that an image of the light source is created at an aperture stop;

a second lens group having at least one lens element for receiving the projected light generated by the light source after the projected light has passed through the aperture stop; and a color filter apparatus positioned near the aperture stop having at least one movable filter element for movement into and out of a volume of space occupied by said image of said light source.

12. A lighting system as in claim 11 wherein the movable filter element is translated using a motor.

13. A lighting system as in claim 11 wherein the color filter apparatus includes three color filter elements.

14. A lighting system comprising:

a light source projecting a beam of light;

a first lens group having at least one lens element receiving the projected light such that an image of the light source is created at an aperture stop;

a second lens group having at least one lens element for receiving the projected light generated by the light source after the projected light has passed through the aperture stop; and a dimmer apparatus positioned near the aperture stop having at least one movable element for movement into and out of a volume of space occupied by said image of said light source.

15. A lighting system as in claim 14 wherein the movable element is translated using a motor.

16. A lighting instrument comprising:

a light source projecting a beam of light;

a first lens group having at least one lens element receiving the projected light such that an image of the light source is created at an aperture stop;

a second lens group having at least one lens element for receiving the projected light generated by the light source after the projected light has passed through the aperture stop; and a diffusion apparatus positioned near the aperture stop having at least one movable element for movement into and out of a volume of space occupied by said image of said light source.

17. A lighting instrument as in claim 16, wherein the movable element is translated using a motor.

18. A lighting system comprising:

a light source projecting a beam of light;

a first lens group having at least one lens element receiving the projected light such that an image of the light source is created at an aperture stop;

a second lens group having at least one lens element for receiving the projected light generated by the light source after the projected light has passed through the aperture stop; and a color filter apparatus positioned near said light source and having at least one movable filter element for movement into and out of said beam of light, wherein an image of said color filter elements is created at said aperture stop.

19. A lighting system as in claim 18 wherein the movable filter element is translated using a motor.

20. A lighting system as in claim 18 wherein the color filter apparatus includes three color filter elements.

21. A lighting system comprising:

a light source projecting a beam of light;

a first lens group having at least one lens element receiving the projected light such that an image of the light source is created at an aperture stop;

a second lens group having at least one lens element for receiving the projected light generated by the light source after the projected light has passed through the aperture stop; and a dimmer apparatus positioned near said light source and having at least one movable element for movement into and out of said beam of light, wherein an image of said dimmer is created at said aperture stop.

22. A lighting system as in claim 21 wherein the movable element is translated using a motor.

23. A method for providing lighting, comprising the steps of:

providing a light source projecting a beam of light;

providing a projection optical system including at least two lens elements and having an aperture stop, said optical system forming an image of said light source at a location contiguous to said aperture stop; and moving at least one movable filter element into the aperture stop in a volume of space occupied by the image of the light source to provide a desired color density or light intensity of projected light.

24. A method as in claim 23, wherein the movable filter element is moved using a motor-drive apparatus connected to the movable color filter element.

25. A method as in claim 23 wherein the one movable filter element is a color filter element.

26. A method as in claim 23 wherein the one movable filter element is a dimmer filter element.

27. A method as in claim 23 wherein the one movable filter element is a diffusion element.

28. A method as in claim 23 wherein the step of moving includes moving three complementary color filter elements.

29. A method as in claim 23 wherein the light source includes a concave reflector for directing the beam of light.

30. A method for providing lighting, comprising the steps of:

providing a light source projecting a beam of light;

providing a projection optical system including at least two lens elements and having an aperture stop, optical system forming an image of said light source at a location contiguous to said aperture stop; and moving at least one movable filter element into the beam path at a location near said light source such that a real image of the filter element is formed at said aperture stop to provide a desired color density or light intensity of projected light.

31. A method as in claim 30 wherein the movable filter element is moved using a motor-drive apparatus connected to the movable color filter element.

32. A method as in claim 30 wherein the one movable filter element is a color filter element.

33. A method as in claim 30 wherein the one movable filter element is a dimmer filter element.

34. A method as in claim 30 wherein the step of moving includes moving three complementary color filter elements.

35. A method as in claim 30 wherein the light source includes a concave reflector for directing the beam of light.

* * * * *